United States Patent [19]

Vangaever et al.

[11] Patent Number: 4,595,462

[45] Date of Patent: Jun. 17, 1986

[54] METHOD FOR DETERMINING CURRENT EFFICIENCY IN GALVANIC BATHS

[75] Inventors: Frank Vangaever; Jacky Vanhumbeeck, both of Brugge, Belgium

[73] Assignee: Siemens Aktiengesellschaft, Berlin & Munich, Fed. Rep. of Germany

[21] Appl. No.: 284,100

[22] Filed: Jul. 16, 1981

[30] Foreign Application Priority Data

Aug. 13, 1980 [DE] Fed. Rep. of Germany ..... 3030664

[51] Int. Cl.[4] ..... G01N 27/46

[52] U.S. Cl. ..... 204/1 T; 204/434; 204/412; 204/290 F

[58] Field of Search ..... 204/1 T, 195 R, 14 R

[56] References Cited

U.S. PATENT DOCUMENTS

| | | | |
|---|---|---|---|
| 3,215,609 | 11/1965 | Chapelaine | 204/1 T |
| 4,102,770 | 7/1978 | Moriarity et al. | 204/195 R |
| 4,132,605 | 1/1979 | Tench et al. | 204/1 T |
| 4,153,521 | 5/1979 | Litvak et al. | 204/1 T |
| 4,229,264 | 10/1980 | Graunke | 204/1 T |
| 4,310,389 | 1/1982 | Harbulak | 204/1 T |

FOREIGN PATENT DOCUMENTS 1935231 11/1970 Fed. Rep. of Germany ... 204/195 R

OTHER PUBLICATIONS

"Galvanotechnik", vol. 1, 1941, pp. 18–20.

"Handbuch der Galvanotechnik", vol. III, 1969, pp. 438–439.

Blum et al, "Principles of Electroplating & Electroforming", 3d. Ed., 1949, pp. 39–42.

*Primary Examiner*—T. Tung

*Attorney, Agent, or Firm*—Hill, Van Santen, Steadman & Simpson

[57] ABSTRACT

A method for determining current efficiency in a galvanic bath employs a measuring cell within which a sample is introduced from the galvanic bath. In this sample, onto a preferably rotating electrode metal is precipitated. A negative voltage is applied at constant current during a first predetermined time during the precipitating. Thereafter, the precipitated layer is anodically eroded by use of a suitable electrolyte solution upon pole-reversal of the DC voltage. The current efficiency is then calculated.

18 Claims, 1 Drawing Figure

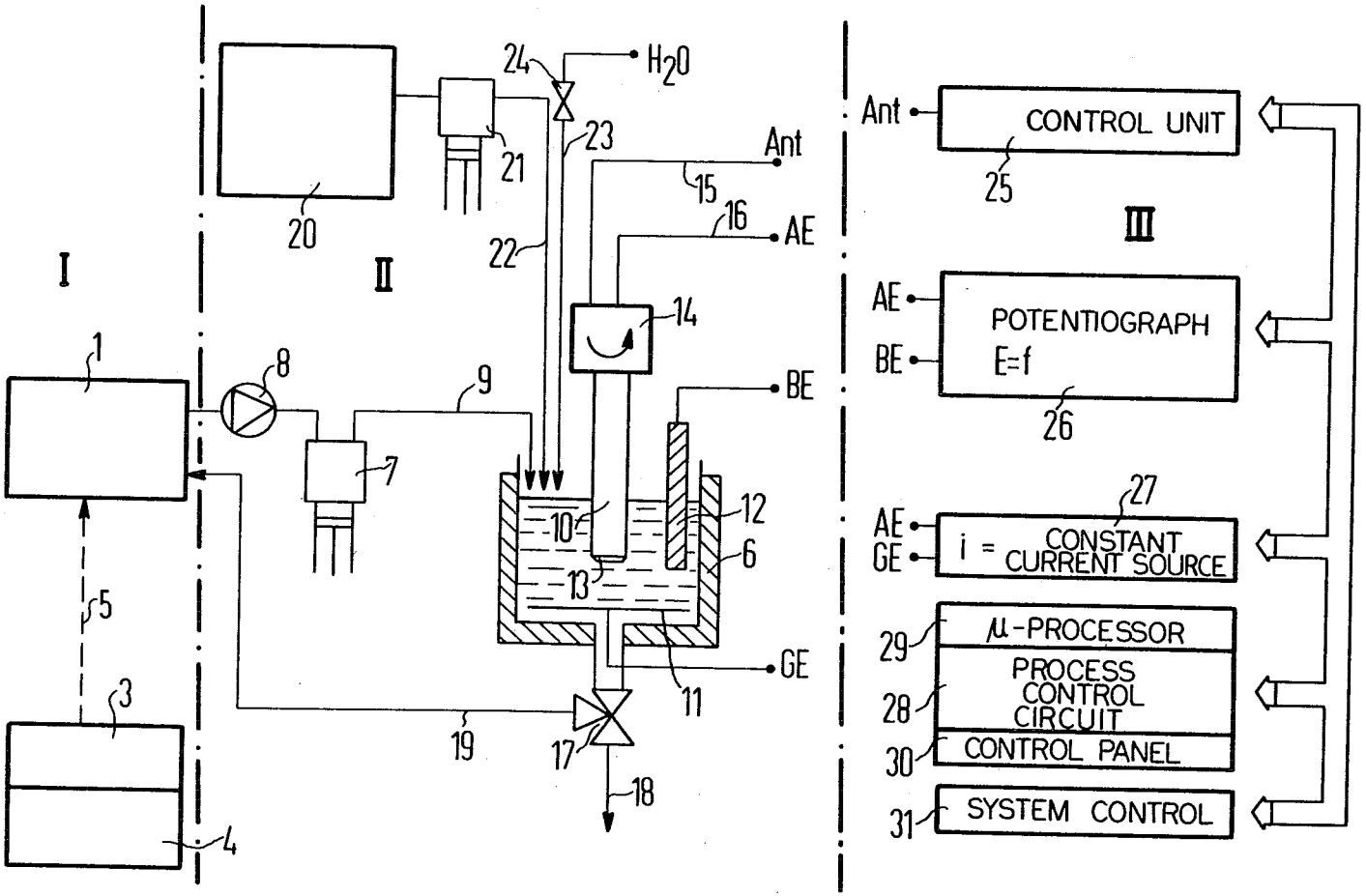
CONTROL UNIT
25
III
POTENTIOGRAPH
E=f
26
27
CONSTANT
i = CURRENT SOURCE
µ-PROCESSOR
PROCESS
CONTROL
CIRCUIT
CONTROL PANEL
SYSTEM CONTROL
Ant
AE
BE
AE
GE
29
28
30
31
Ant
AE
BE
GE
H2O
15
16
14
12
6
11
23
24
21
22
10
13
18
17
9
19
II
20
7
8
I
1
5
3
4

METHOD FOR DETERMINING CURRENT EFFICIENCY IN GALVANIC BATHS

BACKGROUND OF THE INVENTION

The invention relates to a method for determining electrolytic process current efficiency in galvanic baths.

In metal precipitation, fluctuations in the current efficiency lead to fluctuations in the layer thickness, particularly when the precipitation process is only conducted according to current density and exposure time (number of ampere-hours). The current efficiency depends not only on the content of the bath components but, rather, also depends on an entire series of influencing parameter values which cannot be identified with standard, analytical methods. Therefore, pure ampere-hour numbers and the usual, analytical monitoring of the bath are not sufficient criteria for keeping the layer thickness constant. On the contrary, what is determinant for keeping a specific layer thickness constant is the product $i \times t \times N$, whereby i is the current (or, respectively, the current density), t is the exposure time, and N is the current efficiency.

SUMMARY OF THE INVENTION

An object of the invention is to create a method for determining the current efficiency in a galvanic bath. In particular, automatic determination of the current efficiency in conjunction with a corresponding control renders possible the observation of constant layer thicknesses, particularly given continuous processing galvanic systems.

According to the invention, the method for determining the current efficiency in galvanic baths consists in that a bath sample is taken from the galvanic bath and, in a measuring cell, metal is precipitated from said sample onto a preferably rotating electrode under the influence of a negative DC voltage given constant current $i_k$ over a predetermined time $t_k$; subsequently, the precipitated layer is anodically eroded with the assistance of a suitable electrolyte solution upon pole-reversal of the DC voltage given a constant current $i_a$ and in a time $t_a$ to be identified. The current efficiency $N_k$ is then calculated according to the equation $$N_k = \frac{i_a \times t_a \times N_a}{i_k \times t_k}$$

where $N_a$ indicates the current efficiency of the anodic erosion.

Preferably, the time required for the anodic erosion of the precipitated metal is determined from a potential/time curve. Accordingly, in order to record the potential/time curve, the potential between the rotating electrode and a reference electrode which exhibits a constant voltage is identified.

In order to determine scatter (fluctuating layer thickness), the time required for the anodic erosion is determined by means of at least two measurements with different distances between the rotating electrode and the counter-electrode.

Preferably, the control of all components required for the automatic implementation of the method and/or the processing of the measured value is carried out by means of a process control circuit.

BRIEF DESCRIPTION OF THE DRAWING

The drawing illustrates a schematic diagram of an arrangement for automatic measurement of current efficiency.

DESCRIPTION OF THE PREFERRED EMBODIMENTS

A process portion in which the process electrolyte is situated and which contains a galvanic bath 1 as its most significant component is referenced I. It is assumed that the galvanic bath is a continuous processing galvanic system. The control units numbered 3 and 4 provide a defined current density (or, respectively, current) control and a specific band speed control for achieving a specific layer thickness, as indicated by broken arrow 5. Such systems are known per se and are not the subject matter of this invention.

A measuring portion for identifying the magnitudes which determine the calculation of the current efficiency is referenced II. It contains a thermostatic measuring cell 6 to which a specific amount of electrolyte solution can be supplied from the galvanic bath 1 with the assistance of a metering syringe 7 via a valve 8 and a line 9.

As its work electrode, the measuring cell 6 has a rotating electrode 10, a counter-electrode 11 placed opposite it, and a reference electrode 12. At its lower end, the work electrode 10 exhibits a metal disk 13 which is opposite the counter-electrode 11. The reference electrode 12 is of a traditional type and, for example, can be a calomel, Ag or AgCL electrode. The counter-electrode 11 can, for example, be a platinum-coated titanium plate or, respectively, may be adapted to the respective measuring task, as is also the metal disk 13 of the work electrode 10. The electric motor drive of the rotating work electrode 10 is referenced 14, and is connected to an electronics portion III via lines 15 and 16, as shall be described in greater detail below.

A three-way tap 17, which is preferably automatically actuatable, is situated at the lower end of the measuring cell 6, and a pipe line 18 which, for example, leads to a waste container, is connected to the three-way tap 17. A further outlet of the three-way tap 18 is connected via a pipe line 19 to the galvanic bath 1 so that the bath samples situated in the measuring cell 6 can be returned into the galvanic bath 1, this being particularly of significance upon employment of a precious metal electrolyte.

20 indicates an electrolyte container in which a suitable electrolyte solution is situated and which can likewise be supplied to the measuring cell 6 via a pipe line 22 with the assistance of a metering syringe 21. Further, water or some other fluid for rinsing and cleaning can be supplied to the measuring cell 6 via a pipe line 23 and a valve 24.

The electronics part III contains a control unit 25 for the rotating work or operating electrode 10, whose output Ant is connected to the terminal of the line 15 provided with the same reference symbol. The rotational speed of the work electrode 10 can be prescribed via the control unit 25. A potentiograph 26 serves for recording a voltage potential/time curve. The outputs AE and BE of the potentiograph 26 are connected to the correspondingly referenced terminals AE and BE of the work electrode 10 or, respectively, of the reference electrode 12.

The work electrode 10 and the counter electrode 11 are in a circuit which can be supplied with a constant current from a current source 27. The outputs AE and GE of the current source 27 are connected to the correspondingly referenced terminals of the work electrode 10 or, respectively, of the counter-electrode 11.

Finally, the electronics part III also contains a process control circuit 28 with a micro-processor 29 as well as a control panel 30. Furthermore, the entire system is equipped with a system control 31. Thus, for example, the rotational speed of the work electrode 10 can be set to the desired current density, i.e., to the electrolyte to be investigated by the micro-processor 29 and can be controlled by it. Further, the entire sequence of the measuring operation and the control of the current density and of the band speed of the galvanic bath can be controlled by the same micro-processor 29.

The measuring cycle consists of the following steps. A specific amount of electrolyte solution is removed from the galvanic bath 1 with the assistance of the metering syringe 7, and this bath sample is introduced into the thermostat-equipped measuring cell 6. Accordingly, the temperature in the measuring cell during precipitation is held equal to the temperature in the galvanic bath 1.

Over a prescribed time $t_k$, metal is precipitated with a constant current $i_k$ (or, respectively, current density $j_k$) which corresponds as precisely as possible to the current density in the galvanic bath 1. The product $i_k \times t_k$ corresponds to the amount of electricity supplied (number of ampere-hours). In practice, however, only a part $N_k$ of this overall amount of electricity is used for the actual metal precipitation; therefore, the magnitude $N_k$ is the current efficiency which is sought for the present process.

The sample or information value of the automatic determination of current efficiency in the measuring cell 6 will be all the greater the more precisely the process sequence in the galvanic bath 1 is simulated in the measuring cell 6.

In order to be able to employ high current densities in the measuring cell, as are standard, for example in continuous processing systems, the rotating work electrode 10 is used to increase the material transport and to keep it constant. The setting of the corresponding rotational speed of the work electrode and the current density $j_k$ are controlled by the micro-processor 29. As soon as the pre-set electrolysis time $t_k$ is reached, the current is switched off and the bath sample is returned from the measuring cell 6 via the three-way tap 17 and the line 19 to the galvanic bath 1. Via valve 24, the process control 28 subsequently rinses the measuring cell 6 with water from line 23 which is then withdrawn via line 18.

Subsequently, a defined amount of electrolyte solution is introduced into the measuring cell 6 from the electrolyte container 22 with the assistance of the metering syringe 21. This electrolyte solution is matched to the metal precipitation. However, it should render possible a constant, 100% current efficiency if possible during the erosion of the metal precipitated on the metal disk 13 of the work electrode 10. The potentials at the work electrode 10 and at the counter-electrode 11 are reversed, whereby the anodic current $i_a$ and the optimum rotational speed of the work electrode 10 required for the erosion are set with the assistance of the micro-processor 29. During the anodic erosion, the temperature is likewise held constant. It can be kept lower for reasons of process engineering, in order, for example, to avoid the formation of vapors.

In order to record the voltage potential/time curve, the voltage potential/time data are continuously inscribed in the micro-processor 29 and the end point is determined therefrom. The potential curve between the work electrode 10 and the reference electrode 12 during erosion can be recorded with the assistance of the potentiograph 26. The end point of the metal erosion produces the time $t_a$ and is indicated in the potential/time curve by a large change in voltage potential. After the end point has been determined, the current supplied to the electrodes is shut off. Thereafter, the measuring cell is emptied, rinsed and prepared for a new measurement.

Under certain conditions, the work electrode must be cleaned of the remaining precipitations. For this purpose, an appropriate, different fluid is employed.

The amount of electricity required for the erosion is equal to $i_a \times t_a \times N_a$, whereby $N_a$ is the anodic current efficiency. By means of a suitable selection of the electrolyte solution, the anodic current efficiency $N_a$ can be kept equal to 1. The current efficiency can now be calculated in the following manner with the assistance of the micro-processor 29:

$$N_k = \frac{i_a \times t_a \times N_a}{i_k \times t_k}$$

Together with the current density and the rotational speed which have been set, this value can be placed on record. Preferably, the current density in the galvanic bath and/or the exposure time will be controlled as a function of the current efficiency ($N_k$).

The evaluation of the potential/time curve for the determination of $t_a$ can be undertaken in a manner known per se, for example, by means of the point of intersection of straight lines by linear sections of the curve or by means of a turning point given a S-shaped curve.

The scatter of an electrolyte can also be determined with the inventive method. What is meant by scatter is the fluctuating layer thickness occurring on a part to be galvanized when the distance between the surface of the part and the anode is not constant. According to a further feature, at least two measurements with different distances between the rotating electrode 10 and the counter-electrode 11 are to be undertaken in order to determine the scatter. In order to determine the scatter, two mutually independent measuring cells are preferably employed with differing distances between the rotating electrode and the counter-electrode. Two $N_k$ values are calculated therefrom; the relationship of these two values is a measure of the scatter.

For determination of the scatter in the aforementioned two-cell system or in a single cell, a rotating electrode is preferably employed which carries a plurality of suitable metal disks at its lower end, for example, two for a ring disk electrode and three for a split ring disk electrode.

On the basis of these, two or more $N_k$ values are calculated; the relationship of these values is a measure for the scatter.

The inventive measuring principle is not limited to the DC voltage method but, rather, can also be employed, for example, for pulsed precipitation.

In performing the methods of the invention the circuit elements previously described may be constructed as follows by one skilled in this art.

Control units 25 may comprise an electronic circuit for setting and monitoring the stability of the rotational speed of the rotating electrode 10 such as, for example, the commercially available unit type Controvit of the Tacussel Company (France).

Micro-processor 29 is designed as an electronic control on the basis of a micro-processor such as, for example, the SKC85 single board microcomputer of Siemens for the control of all mechanical components such as, for example, valves and pumps, as well as for processing the measured values.

Process control unit 28 is an electronic circuit with which either the galvanizing time or the galvanizing current can automatically be controlled on the basis of the deviation between the measured current yield and the prescribed rated value. This circuit is comprised of a standard stepping motor which is either coupled to the speed governor of the drive motor of the galvanizing system or to the setting head of the current stabilizer and, thus, can carry out the corresponding setting. This stepping motor is directly driven by the micro-processor 29. The calculations necessary for this purpose are contained in the software of the micro-processor.

The task of the micro-processor 29 in the execution of the analysis is to adapt the experimental conditions such as, for example, rotational speed of the electrode, to the measuring task. To accomplish this on the basis of the data which are set at the control panel, the system control 31 is provided which is not a separate part of the device but, rather, a task of the micro-processor, and is indicative of the software.

Potentiograph 26 is a voltage measuring device with high-resistant input (greater than $10^{12}$ ohms) and with, for example, a built-in recording device, such as a potentiograph of the type E436 of the Metrohm company (Switzerland).

With the above described system, one skilled in the art can perform the methods of this invention with no difficulty.

Although various minor modifications may be suggested by those versed in the art, it should be understood that I wish to embody within the scope of the patent warranted hereon, all such embodiments as reasonably and properly come within the scope of my contribution to the art.

We claim:

1. A method for determining current efficiency in a galvanic bath, comprising the steps of: taking an electrolyte solution bath sample from the galvanic bath; providing a measuring cell for receiving the bath sample and precipitating in the cell metal from said sample onto a rotating disc electrode in the measuring cell to which a negative DC voltage is applied at a constant current $i_k$ during a first predetermined time $t_k$; emptying the measuring cell; introducing a different electrolyte solution into the measuring cell; anodically eroding the precipitated layer from the rotating disc electrode by use of the different electrolyte solution upon pole-reversal of the DC voltage at a constant current $i_a$ during a second time $t_a$; and calculating current efficiency $N_k$ according to the equation $$N_k = \frac{i_a \times t_a \times N_a}{i_k \times t_k}$$

where $N_a$ is a current efficiency of the anodic erosion, and where $t_a$ is the time required for the anodic erosion of the precipitated metal.

2. A method according to claim 1 wherein the time $t_a$ required for the anodic erosion of the precipitated metal is determined from analysis of a voltage potential taken between the rotating electrode and a reference electrode of the measuring cell.

3. A method according to claim 2 wherein the time $t_a$ of the anodic erosion of the precipitated metal is determined from a change of potential of a voltage potential/time curve.

4. A method according to claim 1 wherein an electrolyte solution which produces a constant current efficiency of substantially 100% is employed for the anodic erosion.

5. A method according to claim 1 wherein the current $i_k$ is selected in such manner that a current density in the measuring cell approximately corresponds to a current density in the galvanic bath.

6. A method according to claim 1 wherein a temperature in the measuring cell during the precipitation is held equal to a temperature in the galvanic bath.

7. A method according to claim 1 wherein a temperature in the measuring cell is kept constant during the anodic erosion.

8. A method according to claim 1 wherein the current $i_k$ and the rotational speed of the rotating electrode are established as a function of conditions of the galvanic precipitation in the galvanic bath.

9. A method according to claim 1 wherein a current density in the galvanic bath and an exposure time are controlled as a function of the current efficiency $N_k$.

10. A method according to claim 1 wherein the measuring cell is cleaned with a rinsing liquid after conclusion of the metal precipitation.

11. A method according to claim 10 including the step of employing a rinsing fluid for cleaning the rotating electrode.

12. A method according to claim 1 including the step of conducting the constant currents $i_k$ and $i_a$ across the rotating electrode and a counter-electrode opposite said rotating electrode; and that for recording a voltage potential/time curve with a potentiometer associated with the measuring cell, a potential is identified between the rotating electrode and a reference electrode which exhibits a constant voltage.

13. A method according to claim 12 including the step of matching a metal type of a metal disk of the rotating electrode to the galvanic bath.

14. A method according to claim 12 including the step of matching a metal type of the counter-electrode to the galvanic bath.

15. A method according to claim 1 wherein in order to determine scatter, the time $t_a$ required for the anodic erosion is determined by means of at least two measurements with different intervals between the rotating electrode and the counter-electrode.

16. A method according to claim 15 wherein for determination of a scatter or fluctuating layer thickness on a part to be galvanized, when a distance between a surface of the part and an anode in the galvanic bath is not constant, at least two measuring cells are employed with differing intervals between the rotating electrode and the counter-electrode.

17. A method according to claim 1 including the step of automatically implementing a control of all components necessary for processing of a measured value with a control circuit.

18. A method according to claim 17 including the step of utilizing a micro-processor with the process control circuit.

* * * * *